US006988341B2

(12) United States Patent
Regina

(10) Patent No.: US 6,988,341 B2
(45) Date of Patent: Jan. 24, 2006

(54) VENTILATED INTERLOCKING TRANSLUCENT BLOCKS

(76) Inventor: Samuel R. Regina, 3800 S. Cantabria, #1037, Chandler, AZ (US) 85248

( * ) Notice: Subject to any disclaimer, the term of this patent is extended or adjusted under 35 U.S.C. 154(b) by 218 days.

(21) Appl. No.: 10/142,306

(22) Filed: May 8, 2002

(65) Prior Publication Data

US 2003/0208975 A1 Nov. 13, 2003

(51) Int. Cl.
*E04B 5/46* (2006.01)

(52) U.S. Cl. ..... 52/306; 52/171.3; 52/591.1; 52/592.2; 52/591.5

(58) Field of Classification Search ..... 52/306, 52/307, 589.1, 591.1, 592.1, 578, 458, 591.5, 52/592.2, 604, 171.3
See application file for complete search history.

(56) References Cited

U.S. PATENT DOCUMENTS

| | | | | |
|---|---|---|---|---|
| 4,628,652 A | | 12/1986 | Wefels | |
| 4,807,412 A | * | 2/1989 | Frederiksen | 52/177 |
| 4,891,925 A | | 1/1990 | Carlson et al. | |
| 5,014,479 A | | 5/1991 | Yeh et al. | |
| 5,033,245 A | | 7/1991 | Kline | |
| 5,038,542 A | * | 8/1991 | Kline | 52/306 |
| 5,121,575 A | | 6/1992 | DeGarmo et al. | |
| 5,247,773 A | | 9/1993 | Weir | |
| 5,259,161 A | * | 11/1993 | Carter | 52/307 |
| 5,367,846 A | | 11/1994 | VonRoenn, Jr. | |
| 5,588,271 A | * | 12/1996 | Pitchford | 52/306 |
| 5,595,033 A | * | 1/1997 | Frey | 52/306 |
| 5,778,620 A | * | 7/1998 | Fisher | 52/306 |
| 5,836,125 A | | 11/1998 | Regina | |
| 5,904,019 A | * | 5/1999 | Kooij et al. | 52/306 |
| 5,910,086 A | * | 6/1999 | Fisher | 52/306 |
| 5,970,673 A | * | 10/1999 | Fisher | 52/306 |
| 5,987,829 A | * | 11/1999 | Fisher | 52/306 |
| 6,260,317 B1 | * | 7/2001 | Fisher | 52/306 |
| 6,393,786 B1 | * | 5/2002 | Hudson et al. | 52/306 |

* cited by examiner

*Primary Examiner*—Carl D. Friedman
*Assistant Examiner*—Yvonne M. Horton
(74) *Attorney, Agent, or Firm*—Cahill, von Hellens & Glazer P.L.C.

(57) ABSTRACT

A vented hollow translucent/transparent plastic block for use in wall construction includes a single aperture disposed along the lower edge of the plastic block for alleviating pressure within the plastic block and for discharging any condensation within the plastic block that may occur.

30 Claims, 2 Drawing Sheets

VENTILATED INTERLOCKING TRANSLUCENT BLOCKS

BACKGROUND OF THE INVENTION

1. Field of the Invention

The present invention relates to transparent/translucent blocks as building materials used in commercial and residential construction and, more particularly, to ventilated interlocking blocks of manmade materials.

2. Description of Related Art

For decades, hollow glass blocks have been used to form interior or exterior walls or sections thereof in order to permit transmission of light through such walls. Usually, these glass blocks distort any images viewed therethrough or the blocks may be translucent to permit passage of light and yet provide a significant degree of privacy. For example, glass blocks have been used as part of a bathroom wall to permit transmission of light therethrough, particularly important if there are no windows in the bathroom, and yet provide privacy. In a commercial or private environment, walls or wall dividers have been formed of translucent hollow glass blocks to delineate floor space while accommodating light transmission therethrough to create a more airy and open environment without compromising privacy.

Hollow glass blocks serve the sought end result very well but several difficulties are created. First, the glass blocks are relatively heavy and generally are only permitted to be used under building codes in conjunction with supporting brick walls; conventional wood frame construction is generally considered of insufficient structural strength to support glass blocks. Second, transport of the glass blocks from a point of manufacturer to the end user is generally expensive because of the weight and the attendant crating and shipping costs. Third, in order to accommodate the change in pressure within the hollow part of the glass block due to temperature and elevational changes, the glass walls must be very thick. Fourth, assembling a wall or wall section of glass blocks requires a skilled artesian to properly align the glass blocks and to exercise skill in securing the glass blocks to one another with a binding agent.

To overcome the weight and handling difficulties attendant hollow glass blocks, hollow blocks of transparent/translucent manmade materials have been developed; hereinafter referred to as plastic blocks. These plastic blocks generally include interlocking elements to permit seating and rapid assembly. In some circumstances, depending upon the configuration and use of the plastic block, a binding agent must be used. The primary benefits of plastic blocks include light weight, ease of handling and installation, and relatively low cost.

The plastic blocks are hollow and the interior space is sealed against intrusion of foreign matter as well as air. In response to temperature changes or changes in elevation (primarily during shipping), the pressure within the plastic blocks increases and decreases proportionately. The pressure changes within the plastic blocks generally result in inward or outward flexing of the walls of the plastic block. Such flexing creates stresses within the plastic material. During cleaning with conventional cleaning agents, lines of stress become visually apparent. The resulting disfiguration becomes permanent and compromises the aesthetics of the wall or wall section formed of the plastic blocks.

SUMMARY OF THE INVENTION

The present invention is directed to ventilated transparent and/or translucent hollow plastic blocks having interlocking elements for rapidly building a wall or a wall section of such plastic blocks. Ventilation of the glass blocks to avoid imposing stresses on the walls of the glass blocks due to temperature changes and elevational changes is provided. In particular, equalization of pressure within each plastic block with the ambient pressure is provided by a single aperture disposed in the bottom edge of a mounted plastic block.

It is therefore a primary object of the present invention to provide a ventilated plastic block.

Another object of the present invention is to provide a ventilated translucent or transparent plastic block for use as a wall section.

Yet another object of the present invention is to provide a ventilated plastic block having interlocking elements for rapid snap together assembly with adjacent plastic blocks.

Still another object of the present invention is to provide is to provide a single aperture for ventilating a plastic block used in the construction of a wall.

A further object of the present invention is to provide a specifically located aperture in a translucent hollow plastic block to reduce the likelihood of condensation settling on the interior surfaces of the hollow plastic block.

A yet further object of the present invention is to provide a ventilated plastic block which precludes airflow therethrough while accommodating inflow and outflow through a common aperture due to changes in internal pressure resulting from temperature and elevational changes.

A still further object of the present invention is to avoid creation of stresses in the side walls of a transparent/translucent hollow plastic block due to temperature and elevational changes.

A still further object of the present invention is to provide a method for avoiding stressing the side walls of a hollow plastic block due to temperature and elevational changes.

These and other objects of the present invention will become apparent to those skilled in the art as the description there proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Interlocking unventilated plastic locks have been developed by the applicant, as illustrated and described in U.S. Pat. No. 5,836,125. The illustrations and writings contained therein are incorporated by reference herein. Accordingly, many of the features common with the present invention, particularly with respect to the interlocking and alignment elements, will be only summarily discussed as the details thereof are set forth in U.S. Pat. No. 5,836,125.

Figure 1:
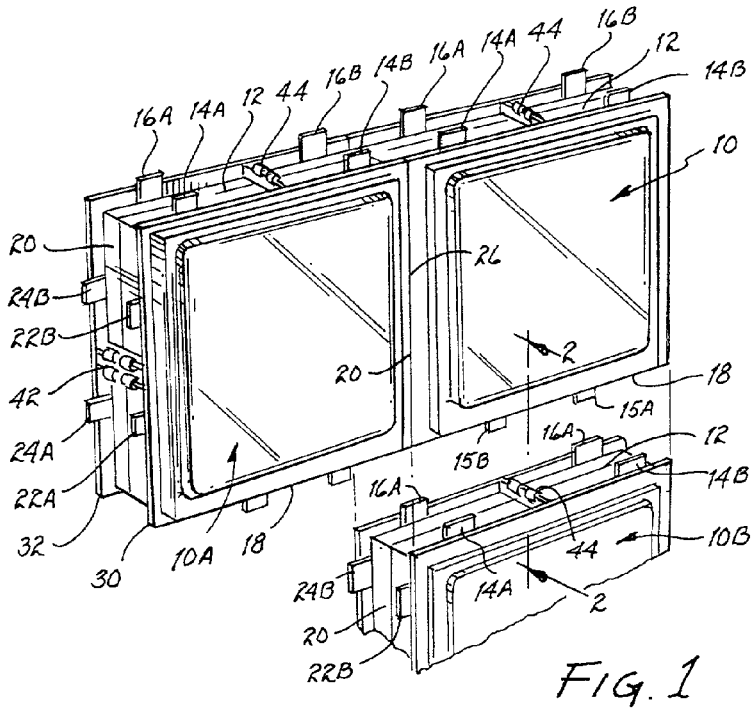
FIG. 1 illustrates a plurality of interlocked plastic blocks.

Referring to FIG. 1 there is shown a plurality of interlocking plastic blocks 10, 10A and 10B which are preferably, but not necessarily, of acrylic material. Edge 12 of each plastic block includes two pairs of alignment tabs 14A, 14B and 16A, 16B. The tabs of each pair of these pairs of tabs are relatively widely spaced from one another as illustrated. Opposite edge 18 of plastic block 10 includes two pairs of alignment tabs of which tabs 15A,15B are shown; these pairs of tabs are spaced closer to one another than pairs of tabs 14A,14B and 16A,16B. Edge 20 of each plastic block also includes two pairs of alignment tabs 22A,22B and 24A,24B. A spacing between the alignment tabs of these two pairs of tabs is less than the space between pairs of alignment tabs 14A,14B and 16A,16B and corresponds with the spacing of pairs of tabs 15A,15B. Edge 26 of each plastic block includes two pairs of alignment tabs equivalent in spacing and location to pairs of alignment tabs 14A,14B and 16A,16B. Each of these alignment tabs bears against the inside surface of a corresponding one of circumferential flanges 30, 32 of an adjacent interlocking plastic block. Moreover, flanges 30, 32 serve as the bearing surfaces between adjacent blocks. Thereby, plastic blocks 10, 10A and 10B are easily assembled with one another in perfect alignment to form a wall section, window, divider, etc.

Generally, an assembly of plastic blocks is bounded by structure such as a strap or the like to ensure stability of the assembled structure wherein the structure is to be used. Additionally, a frame of wood, metal or other material may be used as a boundary within which the plastic blocks are mounted. A mastic or other binding agent may be used to secure the blocks to one another.

Figure 2:
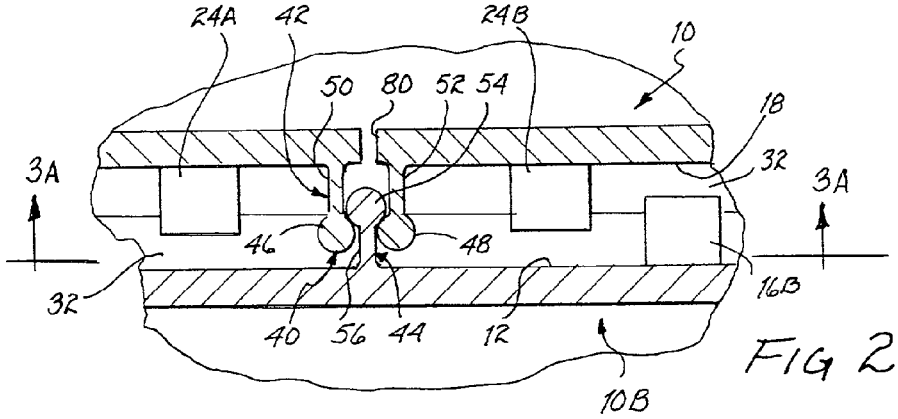
FIG. 2 is a cross sectional view taken along lines 2—2, as shown in FIG. 1.

As particularly shown in FIG. 2, a snap fit mechanism may be incorporated to retain the blocks in place with one another during assembly. As the details of the snap fit mechanism are further described in U.S. Pat. No. 5,836,125 the following discussion will be relatively brief. Snap fit mechanism 40 may include a female receptacle 42 to be engaged by a male coupling 44. The female receptacle includes a pair of cylindrical locking members 46,48 located at the extremity of respective wall members 50,52. Male coupling 44 includes a cylindrical member 54 supported upon a wall member 56. As shown in FIG. 2, the spacing between cylindrical members 46,48 of female receptacle 44 is less than the diameter of cylindrical member 54 of male coupling 44. To permit penetration therebetween, wall members 50,52 of the female receptacle are resilient and sufficiently flexible to permit insertion and removal of the male coupling. As shown in FIG. 1, and other figures, each side of each plastic block may include a pair of snap fit mechanisms 40. As further noted in FIG. 1, edge 12 supports a male coupling 44 and opposite edge 18 supports a female receptacle 42. Edge 20 supports a female receptacle 42 and opposite edge 26 supports a male coupling 44. Thereby, the plastic blocks will be oriented to locate bottom edge 18 of one plastic block adjacent the top edge of another plastic block. When such placement occurs, the alignment tabs will be properly mated and the corresponding snap fit mechanisms will be functional.

Figure 4:
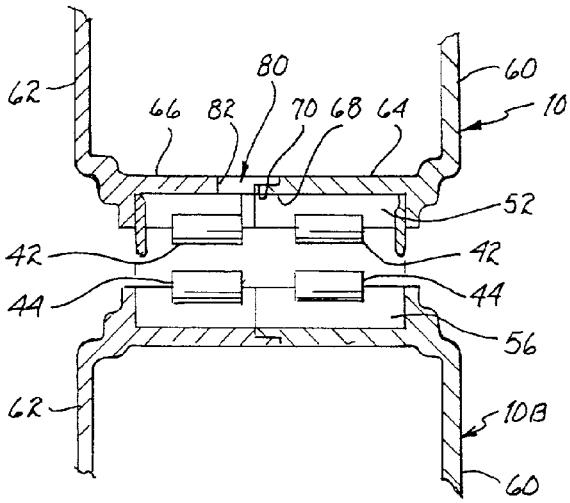
FIG. 4 is a cross sectional view taken along lines 4—4, as shown in FIG. 3A.
Figure 5A:
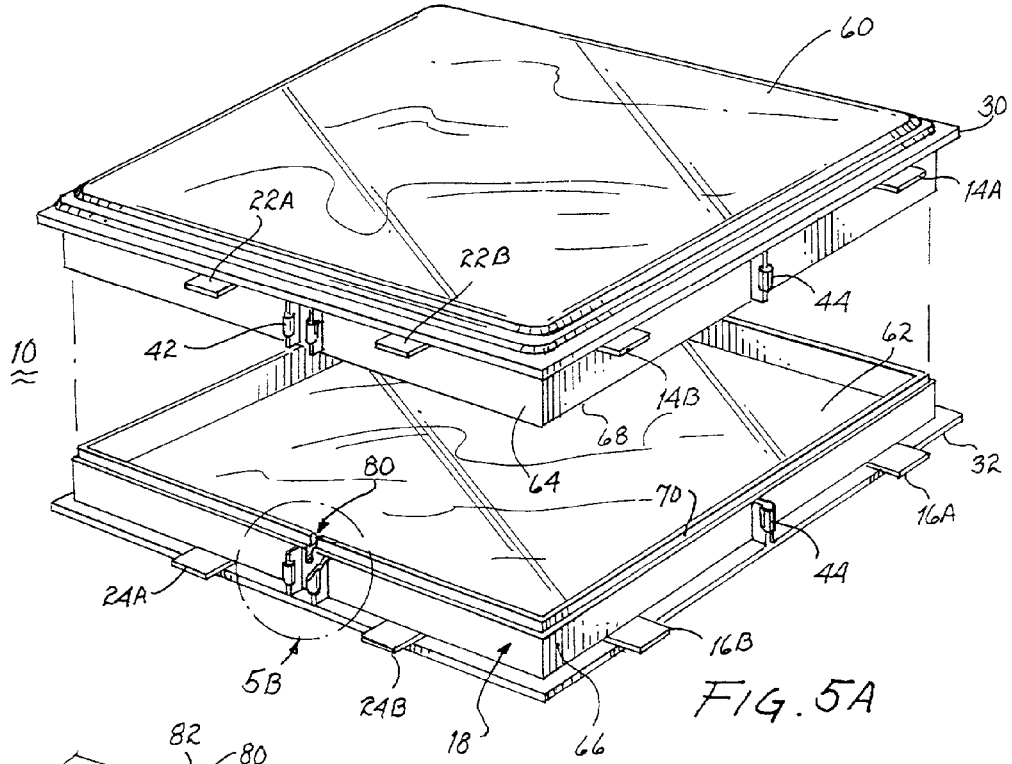
FIG. 5A illustrates the two halves of a plastic lock prior to assembly.

As particularly shown in FIGS. 4 and 5A, each of the plastic blocks (10, 10A, 10B) is formed of two members 60,62. Member 60 includes a four-sided side wall 64 and member 62 includes a similar four-sided side wall 66. For structural reasons and to obtain a good bond between the members, side wall 64 includes a peripheral lip 68 that mates with a peripheral undercut 70 in side wall 66. Upon mating and bonding members 60,62 with one another, an enclosed space is formed within the two members.

During transport of the plastic blocks, changes of elevation occur. Such changes of elevation would create a pressure differential between the space interior of each plastic block and ambient pressure. Unless each plastic block were vented, such pressure differential would cause the sides of the plastic block to flex in response to the degree of pressure differential. Similarly, during changes of the ambient temperature as a result of a plastic block being subjected to solar radiation, other source of heating or a cooling environment, the temperature within a sealed plastic block would change with a commensurate increase or decrease in pressure and the sides of the plastic block would flex in conformance therewith.

One of the reasons for having prior art glass blocks and prior art plastic blocks sealed is to prevent condensation to develop on the inside surfaces due to a change in temperature or ambient pressure by preventing air flow through such a block. However, it has been learned that the plastic blocks of the type illustrated and described herein can be vented to obviate a pressure differential between the interior of the plastic block and the ambient pressure and thereby prevent flexing of the sides of the plastic block. However, such venting must be configured to prevent cross flow within the plastic block. Furthermore, it has been learned that if the vent is on the bottom edge, any condensation that may develop, although unlikely, it can drain through the vent.

Figure 3A:
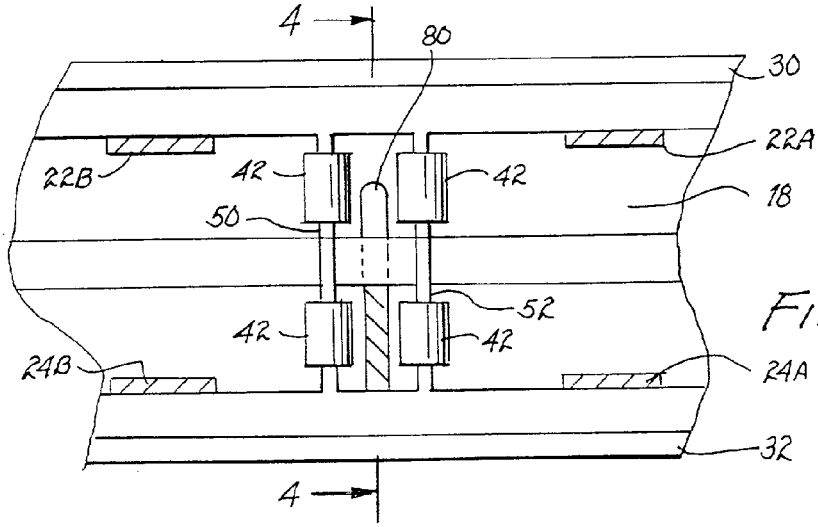
FIG. 3A is a cross sectional view taken along lines 3A—3A, as shown in FIG. 2.
Figure 5B:
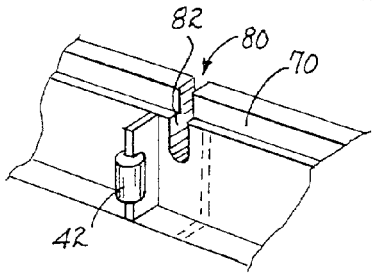
FIG. 5B is a detailed view of the section encircled and identified with reference numeral 5B shown in FIG. 5A.

Referring particularly to FIGS. 4, 5A and 5B, the vent developed for use with plastic block 10 will be described. Vent 80, located in bottom edge 18 of plastic block 10 is formed by a slot 82 extending into side wall 66 past undercut 70. Upon mating of side walls 64,66 lip 68 covers a part of slot 82 to the extent of the width of undercut 70. The resulting vent is particularly shown in FIGS. 2 and 3A.

Vent 80 accommodates a flow of air into and out of plastic block 10 as a function of changes in pressure outside or inside the plastic block. The vent is sized small enough to preclude any cross flow of air within the plastic block. That is, air can not enter at one location and depart at a different location. With such lack of cross flow within the plastic block, it has been learned that condensation within the plastic block will almost never occur. Yet, the use of a single vent of relatively small size will preclude flexing of the sides of the plastic block causing the stresses that ultimately will become visible upon cleaning the plastic block with conventional cleaning agents.

Figure 3B:
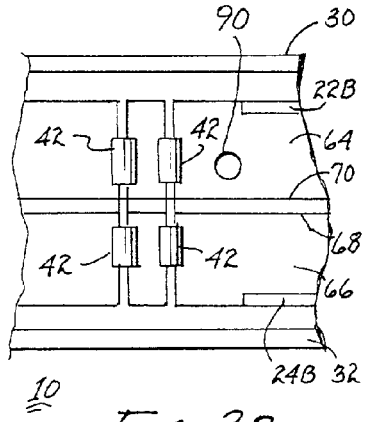
FIG. 3B illustrates a variant of the ventilation aperture shown in FIG. 3A.

FIG. 3B illustrates a variant 90 of vent 80. A simple hole may be drilled in one or the other side walls of block 10 in edge 18 or may be formed therein during fabrication of the respective member 60/62. Under certain circumstances, variant 90 may be formed post manufacturing by drilling a hole, as illustrated.

By experimentation, it has been learned that the size of vent 80 or variant 90 should have an area equivalent to a round hole having a diameter in the range of at least about 0.005 inches to about 0.25 inches. Optimally, the size of vent 80 or variant 90 should have an area equivalent to a circle having a diameter in the range of about 0.012 inches to about 0.015 inches to minimize the likelihood of inflow of moisture and yet permit an outflow of moisture if such inflow does occur. Thereby, an environment of trapped moisture will be eliminated. These area dimensions were developed as a result of significant testing during transport of the plastic blocks over roads having varying elevations and by subjecting them to temperature differentials over a period of time.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

I claim:

1. A vented hollow plastic block for use in a wall section, said plastic block comprising in combination:

a) a pair of members, each of said members including a continuous side wall, said side wall of one of said members including a lip and said side wall of the other of said members including an undercut for receiving and mating with said lip and forming a junction; and b) a slot extending into either one of said side walls, said slot being adapted to be partly covered upon mating of said side walls with one another, the uncovered part of said slot forming a single vent in said hollow plastic block.

2. The vented hollow plastic block as set forth in claim 1 wherein the said vent has an area equivalent to a circle having a diameter in the range of about 0.005 inches to about 0.25 inches.

3. The vented hollow plastic block as set forth in claim 2 wherein said vent has an area equivalent to a circle having a diameter in the range of about 0.012 inches to about 0.015 inches.

4. The vented hollow plastic block as set forth in claim 1 wherein each of said members is made of translucent plastic material.

5. The vented hollow plastic block as set forth in claim 1 wherein each of said members is made of transparent plastic material.

6. The vented hollow plastic block as set forth in claim 1 wherein each of said members is square, wherein said side walls define four edges, and including a snap fit mechanism disposed in each of said edges and adapted for locking engagement with a further plastic block placed there against, said slot being disposed proximate one of said snap fit mechanisms.

7. The vented hollow plastic block as set forth in claim 6 wherein said snap fit mechanism comprises either a female receptacle or a male coupling and wherein said female receptacle is disposed on two of said edges and said male coupling is disposed on the remaining two of said edges.

8. The vented hollow plastic block as set forth in claim 7 wherein each of said female receptacles comprises a pair of adjacent cylindrical members and wherein said slot is disposed intermediate said cylindrical members of only one of said female receptacles.

9. A vented hollow plastic block for use in a wall section, said plastic block comprising in combination;

a) a pair of members, each of said members including a continuous side wall, said side wall of one of said members including a lip and said side wall of the other of said members including an undercut for receiving and mating with said lip and forming a junction; and b) a single aperture disposed in either one of said side walls, said aperture having an area equivalent to a circle having a diameter in the range of about 0.005 inches to about 0.025 inches.

10. The vented hollow plastic block as set forth in claim 9 wherein said aperture has an area equivalent to a circle having a diameter in the range of about 0.012 inches to about 0.015 inches.

11. The vented hollow plastic block as set forth in claim 9 wherein each of said members is made of translucent plastic material.

12. The vented hollow plastic block as set forth in claim 9 wherein each of said members is made of transparent plastic material.

13. The vented hollow plastic block as set forth in claim 9 wherein each of said members is square, wherein said side walls define four edges, and including a snap fit mechanism disposed in each of said edges adapted for locking engagement with a further plastic block placed there against, said aperture being disposed proximate one of said snap fit mechanisms.

14. The vented hollow plastic block as set forth in claim 13 wherein said snap fit mechanism comprises either a female receptacle or a male coupling and wherein said female receptacle is disposed on two of said edges and said male coupling is disposed on the remaining two of said edges.

15. The vented hollow plastic block as set forth in claim 14 wherein each of said female receptacles comprises a pair of adjacent cylindrical members and wherein said aperture is disposed intermediate said cylindrical members of only one of said female receptacles.

16. A vented hollow translucent/transparent plastic block of use in a wall section, said plastic block comprising in combination:

a) a pair of members, each of said members including a continuous side wall, said side walls defining four edges of said plastic block;

b) said side wall of one of said members being in sealed engagement with said side wall of the other of said members; and c) a single aperture disposed in either one of said edges, said aperture having an area equivalent to a circle having a diameter in the range of about 0.005 inches to about 0.25 inches.

17. The vented hollow translucent/transparent plastic block as set forth in claim 16 wherein said aperture has an area equivalent to a circle having a diameter in the range of about 0.012 inches to about 0.015 inches.

18. The vented hollow translucent/transparent plastic block as set forth in claim 16 wherein said aperture is formed at the junction of said side walls.

19. An interlockable building block comprising:

a) a block including spaced apart front and rear surfaces having a perimeter edge and at least three sidewalls spanning the distance between the front and rear surfaces, the front and rear surfaces being dimensioned such that the perimeter edge extends outward from the block sidewalls and defines a protruding ledge;

b) a block fastening system including i) a male coupling element positioned on one of the sidewalls and having a male interlocking element with a defined maximum width and a pedestal element having a first end and a spaced apart second end supporting the male interlocking element at a fixed distance from the block sidewall, the pedestal element having a width less than the maximum width of the male interlocking element to provide a reduced width capture zone located in proximity to the male interlocking element; and ii) a female receptacle positioned on a different one of the sidewalls and including first and second female interlocking elements and first and second laterally deflectable female pedestal elements laterally spaced apart along the length of the sidewall, each pedestal element having a first end coupled to the sidewall and an elevated second end, the second ends of the female pedestal elements supporting the first and second female interlocking elements at a fixed distance above the block sidewall with a lateral spacing less than the maximum width of the male interlocking element, the female receptacle configured to define a male coupling element engagement chamber below the spaced apart second ends of the female pedestal elements whereby the female receptacle laterally deflects around and captures a mateable male coupling element to provide a snap together interlocking coupling with the mateable male coupling element; and c) a single vent disposed in either one of said sidewalls.

20. An interlocking building block assembly comprising:

a) a first block including spaced apart front and rear surfaces having a perimeter edge and at least three sidewalls spanning the distance between the front and rear surfaces, the front and rear surfaces being dimensioned such that the perimeter edge extends outward from the block sidewalls and defines a protruding ledge further including a block fastening system including a male coupling element positioned on one of the sidewalls and having a male interlocking element with a defined maximum width and a pedestal element having a first end and a spaced apart second end supporting the male interlocking element at a fixed distance from the block sidewall, the pedestal element having a width less than the maximum width of the male interlocking element to provide a reduced width capture zone located in proximity to the male interlocking element;

b) a second block including spaced apart front and rear surfaces having a perimeter edge and at least three sidewalls spanning the distance between the front and rear surfaces, the front and rear surfaces being dimensioned such that the perimeter edge extends outward from the block sidewalls and defines a protruding ledge further including a block fastening system including a female receptacle positioned on a different one of the sidewalls and including first and second female interlocking elements and first and second laterally deflectable female pedestal elements laterally spaced apart along the length of the sidewall, each pedestal element having a first end coupled to the sidewall and an elevated second end, the second ends of the female pedestal elements supporting the first and second female interlocking elements at a fixed distance above the block sidewall with a lateral spacing less than the maximum width of the male interlocking element, the female receptacle configured to define a male coupling element engagement chamber below the spaced apart second ends of the female pedestal elements whereby the female receptacle on the second block laterally deflects around and captures the male coupling element on the first block to provide a snap together interlocking coupling between the first and second blocks; and c) a single vent disposed in one of said sidewalls.

21. A hollow rectangular plastic block for installation in a vertical wall section comprising:

a) a pair of rectangular members joined together to form the block, each member including a continuous end wall and a continuous sidewall, one sidewall member including a lip and the other sidewall member including an undercut for mating with the lip to form an airtight seal between the mated sidewall member to define a sealed interior chamber having a lower sidewall surface, an upper sidewall surface and vertically oriented left and right sidewall surfaces; and b) a single vent penetrating upwardly through the lower sidewall surface establishing a pressure equalizing passageway between the sealed interior chamber and the ambient atmosphere, the vent representing the only air flow communication path between the sealed chamber and the ambient atmosphere, the vent having a cross sectional area equivalent to a circle having a diameter in the range of about 0.005 inches to about 0.25 inches.

22. The hollow rectangular plastic block of claim 21 wherein the vent is laterally displaced away from the vertically oriented left and right sidewall surfaces.

23. The hollow rectangular plastic block of claim 22 wherein the vent is located in a central portion of the lower sidewall.

24. The hollow rectangular plastic block of claim 23 wherein the vent penetrates substantially vertically upwardly through the lower sidewall.

25. The hollow rectangular plastic block of claim 24 wherein the vent is formed as a cylindrical passageway.

26. The hollow rectangular plastic block of claim 23 wherein the vent is located in a central area relative to the vertically oriented block end walls.

27. The hollow rectangular plastic block of claim 24 wherein the vent has a cross sectional area equivalent to a circle having a diameter in the range of from about 0.012 inches to about 0.015 inches.

28. The hollow rectangular plastic block of claim 21 wherein the block is formed as a square with parallel top and bottom sidewalls, parallel left and right sidewalls and parallel end walls.

29. An interlockable hollow, rectangular plastic block for installation in a vertical wall section, comprising:

a) a hollow rectangular block including vertically oriented, spaced apart front and rear surfaces having a perimeter edge and vertically oriented left and right sidewalls and vertically oriented top and bottom sidewalls spanning the distance between the vertically oriented front and rear surfaces, the front and rear surfaces being dimensioned such that the perimeter edge extends outward from the block sidewalls and defines a protruding ledge, the hollow interior of the block defining a sealed interior chamber having a lower side surface, an upper side surface and vertically oriented left and right end surfaces; and b) a single vent penetrating upwardly through the bottom block sidewall establishing a pressure equalizing passageway between the lower side surface of the sealed interior chamber and the ambient atmosphere outside the chamber, the vent representing the only air flow connection path between the sealed chamber and the ambient atmosphere, the vent having a cross sectional area equivalent to a circle having a diameter in the range of about 0.005 inches to about 0.25 inches.

30. The interlockable hollow, rectangular plastic block fastening system of claim 29, including:

a) a male coupling element positioned on one side of the sidewalls and having a male interlocking element with a defined maximum width and a pedestal element having a first and a spaced apart second end supporting the male interlocking element at a fixed distance from the block sidewall, the pedestal element having a width less than the maximum width of the male interlocking element to provide a reduced width capture zone located in proximity to the male interlocking element; and b) a female receptacle positioned on a different one of the sidewalls and including first and second female interlocking elements and first and second laterally deflectable female pedestal elements laterally spaced apart along the length of the sidewall, each pedestal element having a first end coupled to the sidewall and an elevated second end, the second ends of the female pedestal element supporting the first and second interlocking elements at a fixed distance above the block sidewall with lateral spacing less than the maximum width of the male interlocking element, the female receptacle configured to define a male coupling element engagement chamber below the spaced apart second ends of the female pedestal elements whereby the female receptacle laterally deflects around and captures a mateable male coupling element to provide a snapped-together interlocking coupling with a mateable male coupling element.

* * * * *

UNITED STATES PATENT AND TRADEMARK OFFICE

CERTIFICATE OF CORRECTION

PATENT NO. : 6,988,341 B2
APPLICATION NO. : 10/142306
DATED : January 24, 2006
INVENTOR(S) : Samuel R. Regina It is certified that error appears in the above-identified patent and that said Letters Patent is hereby corrected as shown below:

Col. 5 Line 67
Claim 9, paragraph c, last line, the dimension "0.025" should read --0.25--.

Col. 61 Line 29
Claim 16, paragraph c, line 1 delete "either".

Signed and Sealed this

Sixth Day of March, 2007

JON W. DUDAS
*Director of the United States Patent and Trademark Office*